United States Patent [19]

Gasser

[11] 3,990,612

[45] Nov. 9, 1976

[54] HEATING APPARATUS FOR PRESSURIZED PRODUCTS

[75] Inventor: Edward Bruce Gasser, Piscataway Township, Middlesex County, N.J.

[73] Assignee: Colgate-Palmolive Company, New York, N.Y.

[22] Filed: Mar. 10, 1972

[21] Appl. No.: 233,797

Related U.S. Application Data

[63] Continuation of Ser. No. 769,470, Oct. 9, 1968, abandoned, which is a continuation of Ser. No. 477,655, July 29, 1965, abandoned, which is a continuation of Ser. No. 164,703, Jan. 8, 1962, abandoned.

[52] U.S. Cl. ..... 222/146 HA

[51] Int. Cl.[2] ..... B67D 5/62

[58] Field of Search.... 222/146 R, 146 HA, 146 HE

[56] References Cited

UNITED STATES PATENTS 3,588,469 6/1971 Dillarstone..... 222/146 HA

*Primary Examiner*—Stanley H. Tollberg

*Attorney, Agent, or Firm*—M. M. Grill; N. Blumenkopf; H. S. Sylvester

[57] ABSTRACT

Heated lather is dispensed from a liquid body pressurized under gaseous propellant. Material is passed to a holding chamber which prevents reverse flow and wherein the separated portion is electrically heated. A second electrical device induces a current in the first electrical structure to elevate the temperature after which the material is discharged in an expanded state.

11 Claims, 9 Drawing Figures

INVENTOR.
EDWARD BRUCE GASSER
BY Thomas M. Hammond
Attorney

Fig.6
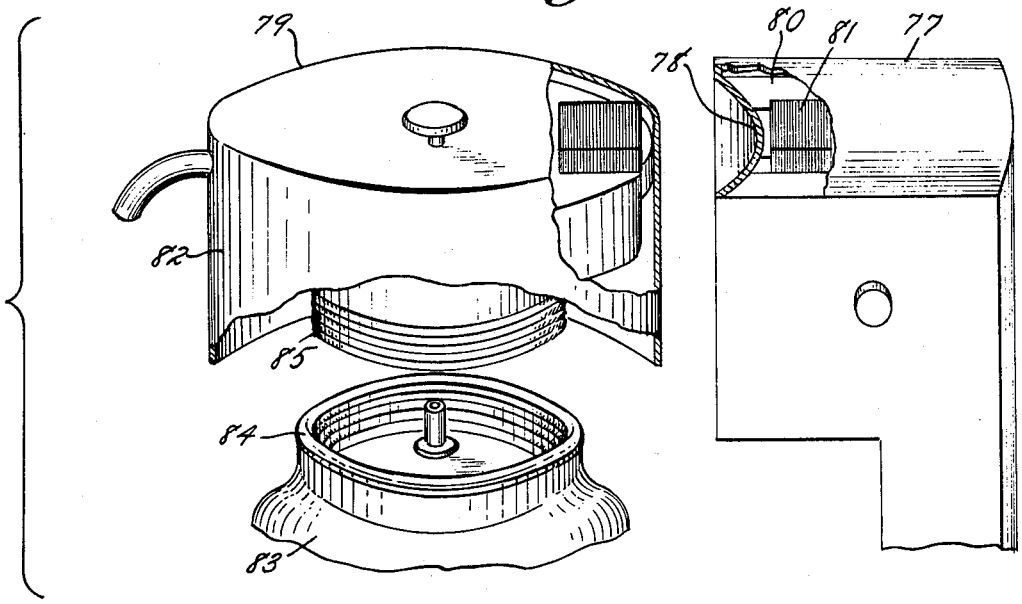
Fig.7
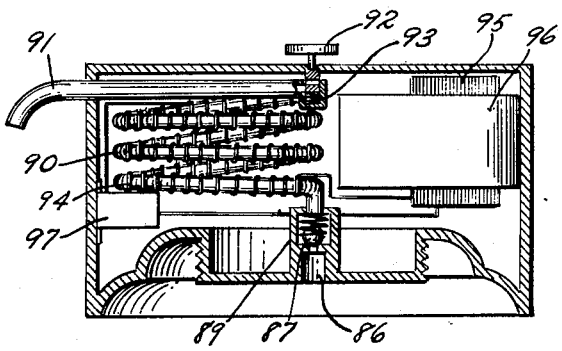
Fig.9
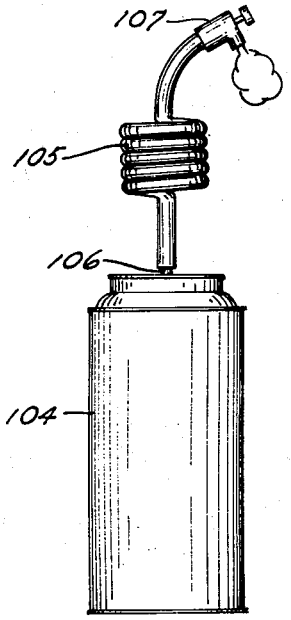
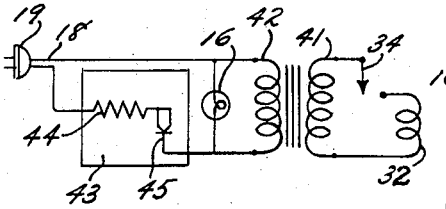
Fig.5
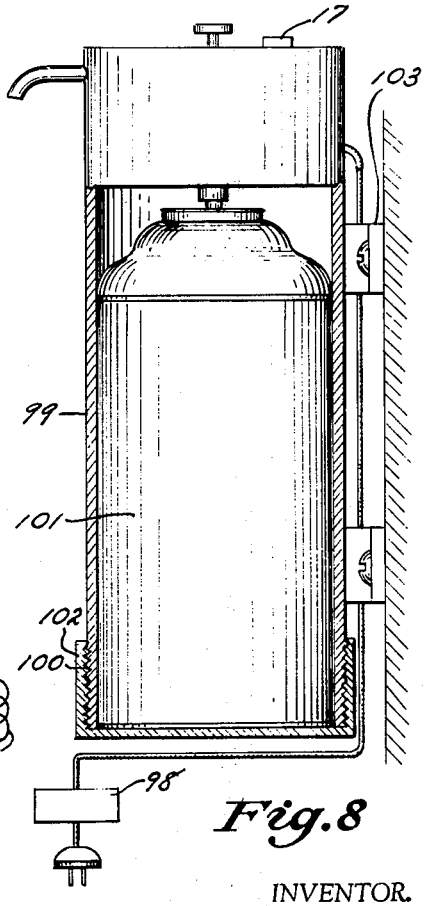
Fig.8
INVENTOR.
EDWARD BRUCE GASSER
BY Thomas M. Hammond
Attorney

HEATING APPARATUS FOR PRESSURIZED PRODUCTS

This is a continuation of copending application Serial No. 769,470 filed Oct. 9, 1968, which application was a continuation of copending application Ser. No. 477,655, filed July 29, 1965, which application was a continuation of copending application Ser. No. 164,703 filed Jan. 8, 1962, all of said applications having been abandoned.

This invention relates to a device and process for dispensing fluent material. More particularly, the invention relates to a device and process for dispensing a fluid material at a modified temperature in an expanded state.

The use of pressurized dispensing containers for a large variety of products has become popular in a number of fields, including cosmetics. For example, various types of creams, shaving lathers, emollients and other types of cosmetic preparations have met with consumer acceptance in the form of aerosol packages. With many of these products, it is sometimes desirable to dispense the material at a modified temperature.

The present invention provides a device and process to achieve this result. The device and process disclosed and claimed herein, although readily adaptable to a wide variety of applications, are particularly useful in the field of dispensable pressurized "aerosol" compositions and especially for the dispensing of heated shaving lather. In the interest of simplicity, the invention will be described in its application to the provision of heated shaving lather. However, it is to be understood that the present invention can be employed with other products, too, as will be apparent from the following description, taken in conjunction with the accompanying drawings, in which:

FIG. 5 is a schematic diagram of the electrical circuit of the device of this invention;

FIG. 6 is a partial sectional isometric view in elevation of another embodiment of the device in position for assembly onto a dispensing container, illustrating the primary and secondary inductors and means for attaching a container of pressurized dispensable shaving cream to the warming head;

FIG. 7 is a partial sectional isometric view in elevation of the warming head shown in FIG. 6;

FIG. 8 is a partial sectional view in elevation of another embodiment of the device showing the container of pressurized shaving cream completely enclosed within a casing; and FIG. 9 is a view in elevation of a simplified embodiment of a device for dispensing shaving lather at a modified temperature.

In accordance with the invention, a device for dispensing a fluent material, such as liquid shaving cream, at a modified temperature, from a pressurized source which contains the fluent material and a propellant, comprises means for withdrawing, separating or isolating a portion of pressurized fluent material from the source, and for modifying the temperature of the separated portion while holding it under pressure and means for dispensing the separated portion at reduced pressure in an expanded state after temperature modification thereof. Most advantageously, the separated portion of fluent material is held under pressure sufficient to retain it in a substantially unexpanded state. The invention also includes a process which comprises withdrawing a portion of fluent material from a pressurized source, modifying the temperature of the separated fluent material while it is held under pressure in a temperature modification zone, preferably while the fluent material is held under sufficient pressure to retain it in a substantially unexpanded state, and dispensing the separated fluent material at reduced pressure in an expanded state after the temperature thereof has been modified.

The propellant used in the pressurized dispensing container can vary widely. Any propellant material generally employed in pressurized dispensing containers is suitable in the practice of the present invention, although the liquefied gases are preferable. Among these are the poly-halogenated lower hydrocarbons, like chlorinated and fluorinated methanes and ethanes, and the lower hydrocarbons, such as propane, butane and isobutane and related compounds. Compressed gases such as nitrogen, oxygen, nitrous oxide and carbon dioxide may also find use.

Figure 1:
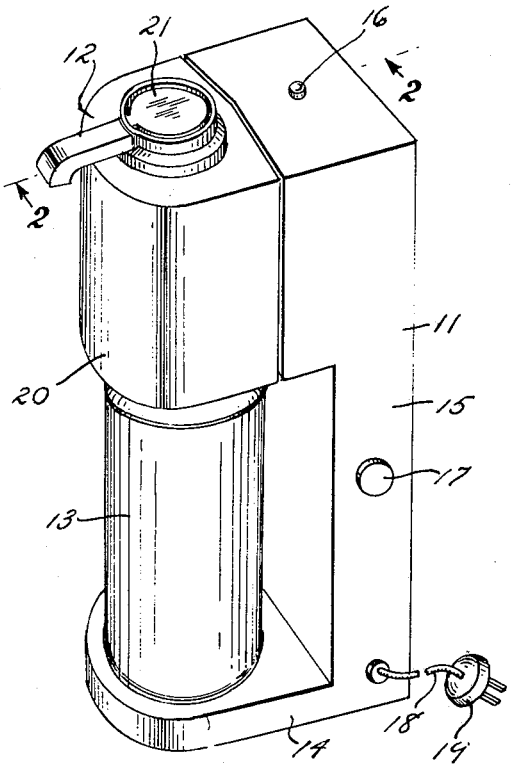
FIG. 1 is an isometric view in elevation of a dispensing device for producing heated shaving lather in accordance with this invention.

Referring to FIG. 1, a device suitable for dispensing heated shaving lather in accordance with the invention comprises a support member designated generally by numeral 11 and a warming head 12 adapted to be attached to a pressurized dispensing container 13 full of liquid shaving cream and a propellant. The support member has a base 14 which can be removable, if desirable, and an enlarged upright back 15. The support member can be fabricated from a wide variety of materials such as metals, plastics, ceramic materials and the like, but is preferably plastic, and has a removable back panel, not shown, to permit access to the interior thereof. Disposed within the upright back 15 is the primary inductor circuit more specifically discussed hereinbelow. An indicator light 16 and an actuator button 17 to close the primary inductor circuit are located on the support member as illustrated. An electric lead cord 18 equipped with a plug 19 is connected to the primary inductor circuit located therein. The support member is adapted to receive the warming head 12 and container 13, as illustrated, and the upper part of the support member is adapted or shaped so that the warming head will rest in close association therewith.

The warming head 12 can vary widely in construction and in the preferred forms of the device contains the major essential elements of the invention, that is, means for separating a portion of liquid shaving cream from the pressurized container, means for maintaining the separated portion in a substantially unexpanded state and for modifying the temperature thereof and means for dispensing the heated separated portion in an expanded state in the form of a lather, as well as related elements. As shown in FIG. 1, the warming head has an outer casing 20 which can be made from the same material as the support member 11 or a different material. A suitable outlet valve and actuator designated generally by numeral 21 are disposed on the warming head and communicate with the interior of the warming head as explained more clearly.

Figure 2:
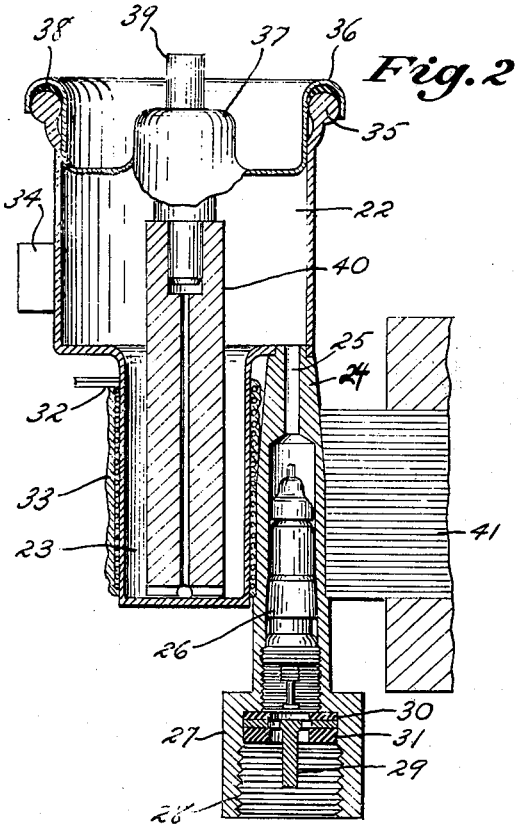
FIG. 2 is a partial sectional view in elevation taken across line 2—2 of FIG. 1 and shows the detailed construction of a preferred form of chamber and related elements of a warming head, with the casing removed.

In FIG. 2, there is shown a preferred embodiment of the essential elements located within the warming head. The means for maintaining a portion of liquid shaving cream from the container in substantially unexpanded state and modifying the temperature of the separated portion comprises a chamber 22, which has a more restricted lower section 23. The chamber is made of a metal such as aluminum, which has good head transfer properties and transmits heat to liquid shaving cream contained therein. The larger upper section of the chamber has an opening therein into which the means for separating a portion of liquid shaving cream, a tube 24, is press-fitted in pressure tight relationship and soldered or brazed at the juncture between the tube and chamber to insure against leakage. The passageway through the tube is somewhat restricted, as shown at 25, at that end where it is inserted into the opening in the chamber. This gives added strength at the joint. However, the remaining length of the tube has a greater internal diameter and is fitted with a suitable check valve 26 which opens to permit liquid shaving cream to flow into the upper part of the chamber in response to pressure changes in the system as set forth more fully hereinbelow. At the end opposite its juncture with the chamber, tube 24 is equipped with a fitting 27 which is internally threaded at 28 and mates threads (not shown) on the outlet or discharge valve of container 13. A flanged actuating pin 29 is disposed within fitting 27 and extends downwardly along its central axis. To insure a leakproof fit to container 13, gaskets 30 and 31 are located within the fitting on the upper and lower side of the pin flange. When fitting 27 is threaded onto container 13, pin 29 extends down to an outlet or discharge vlave of the container and holds the container valve permanently down, in open position. An insulated nichrome wire resistance heating element 32 is wrapped around the lower restricted section 23 of the chamber and is coated with an epoxy resin 33 or other similar material. The resistance heating element 32 is connected to the winding of a secondary inductor. Connected in series with the resistance heating element is a thrermostat 34 attached to the side of the chamber 22 in any convenient manner, such as with epoxy cement or similar material. The upper large section of chamber 22 is provided with a rim 35 around which the valve cup 36 of a suitable dispensing valve 37 is crimped in place along with a sealing gasket 38 to insure a leakproof fit. The means for dispensing the separated heated shaving cream to the atmosphere as expanded lather includes hollow valve stem 39 which extends up through an opening in the casing and to which the valve actuator 21 is press-fitted. A dip tube 40 of polyethylene, polystyrene or similar material is fitted on the lower end of the valve cup and extends downwardly to a point just above the bottom of the restricted section of chamber 22. The secondary inductor 41 is located just to the rear of the chamber and rests on the bottom of the casing which surrounds the entire assembly and holds it firmly in place.

Any suitable means to hold the elements firmly within the warming head casing can be employed. Preferably, however, the casing 20 is molded to a size suitable for insertion of the elements and to hold them firmly in place. If desirable, the elements of the warming head can be placed in a suiable mold and a casing material, preferably plastic, introduced around them to form a completely form-fitting monolithic housing. Another alternative manner is to provide a bracket (not shown) which is attached to the chamber and secondary inductor to hold them together and which is then secured to the walls of the casing by means of screws.

Fitting 27 is associated with an opening in the bottom of the casing so that container 13 can be threadably attached thereto. The chamber and tube associated therewith are generally constructed of a good heat conductive metal such as aluminum, copper, stainless steel or similar materials. However, aluminum or stainless steel is preferred. The chamber should be large enough to provide a sufficient amount of warm shaving lather for at least one shaving operation. Furthermore, the chamber and tube are made at least strong enough to withstand pressures which the container will withstand. Sealing gaskets in addition to those specifically mentioned can be employed where necessary to insure a leakproof system.

The electrical circuit of the device shown schematically in FIG. 5 comprises a primary circuit located in the support member 11 and secondary circuit located in the warming head 12. It includes a primary industor 42 connected in series with a thermostatic time delay switch 43, comprising a resistance element 44 and contacts 45 actuated and latched by button 17 and released by deformation of a bimetal strip, not shown. In addition a megnetic switch, not shown, can be inserted in the circuit as a protective device to prevent operation of the primary circuit without the warming head in place. These elements are all connected to the electric lead cord 18 equipped with plug 19 for attachment to an electrical outlet, as mentioned hereinabove. Indicating light 16 is also connected in parallel with the primary inductor circuit. The secondary circuit includes a secondary inductor 41 which, as with primary inductor 42, forms one half of a transformer across which a current is induced when the warming head is in position on the support member and the inductors are in a relatively close spatial relationship. The secondary inductor 41, as mentioned hereinabove, is connected in series to a resistance heating element 32 and thermostat 34. The inductors 41 and 42 are completely enclosed in the casing 20 of the warming head and the support member, respectively, and do not make any direct physical contact with each other. Such an arrangement provides a high degree of protection against electric shock or other mishap when the warming head is placed on or removed from the support, or in operation.

Figure 3:
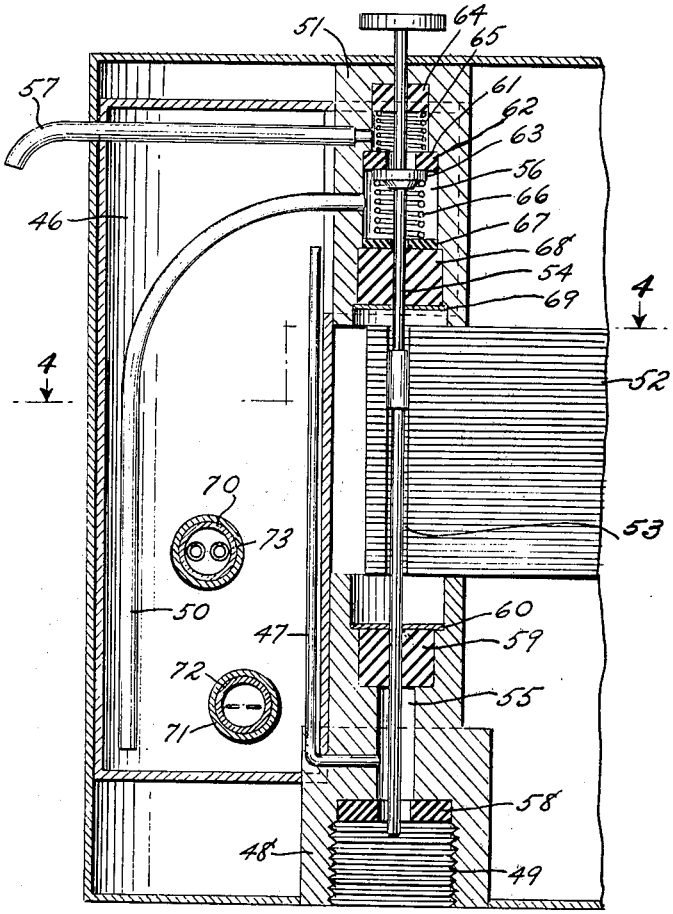
FIG. 3 is a partial sectional view in elevation of another embodiment of the chamber and related elements.
Figure 4:
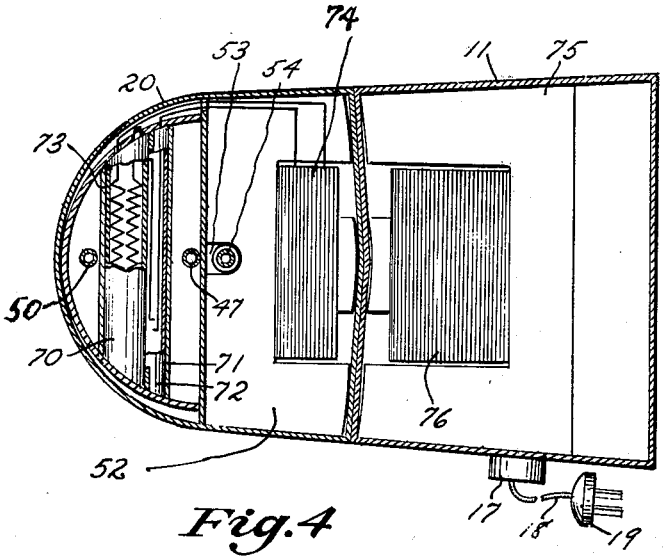
FIG. 4 is a sectional plan taken across line 4—4 of FIG. 3 illustrating the relationship of primary and secondary inductors and the position of the heating element and a thermostat in the embodiment of the chamber showing in FIG. 3.

In FIGS. 3 and 4, there is illustrated a modification of the warming head having an elongated stainless steel chamber 46, shaped like one half of a cylinder, which communicates with container 13 through inlet tube 47 by way of stainless steel fitting 48 which contains such an enlarged threaded opening 49 that mates with a suitable threaded outlet portion on the pressurized dispensing container 13. In addition to stainless steel, fitting 48 can be constructed of any suitable material, such as molded nylon or other plastics. An outlet tube 50 is located within chamber 46 and communicates with stainless steel valve housing 51 located near the top of the chamber. Between fitting 48 and outlet valve housing 51 is a secondary inductor 52. The secondary inductor shown more completely in FIG. 4 has a void 53 which permits passage of actuator rod 54 that extends through bores 55 and 56 contained within fitting 48 and outlet valve housing 51, respectively, and passes into valve housing of container 13 to open that valve when the actuator rod is despressed. Passing through the upper part of the chamber is dispensing outlet 57 which communicates with the outlet valve housing 51. A sealing gasket 58 and neoprene shaft seal 59 are disposed in fitting 48, as shown. A stainless steel insert 60 is positioned over the shaft seal. The bore 56 of the outlet valve housing is of small diameter at the upper end and increases in diameter at the lower end just below the junction of outlet 57 with the housing, thereby forming a shelf or seat 61 against which neoprene seal 62 is urged by valve 63 which is splined to actuator rod 54. A neoprene shaft seal 64 is located in the upper part of the outlet valve housing and is held in place by spring 65. An additional spring 66 forcibly urges valve 63 against seal 62 holding the valve in closed position. Spring 66 is held in position by insert 67 and shaft seal 68 which are locked in the base by stainless steel insert 69, which is press-fitted and soldered in place. Both fitting and valve housing 51 are attached to the wall of the chamber by soldering.

The chamber wall has openings therethrough for the reception of metal sleeves or tubes 70 and 71 most clearly shown in FIG. 4. The sleeves are stainless steel and are brazed or soldered to the chamber wall at each end to insure a leakproof fit. They extend completely across and form two tunnels through the chamber. A thermostat 72 is inserted in one tube and an insulated nichrome resistance heating element 73 is inserted through the other. Such an arrrangement prevents the thermostat and heater from coming into direct contact with material in the chamber. On the other hand, if desirable, the elements can be inserted directly into the chamber through openings and be in direct contact with the shaving cream to be heated. The thermostat and resistor are connected in series with the secondary inductor winding 74 as illustrated in FIG. 4. The primary inductor 75 is located in support member 11 and has a winding 76. When the warming head is in place the inductors are in relatively close spatial association, forming a transformer.

Referring now more specifically to FIGS. 6 and 7 the modification of the device therein illustrated is somewhat different in shape and is adapted to be attached to a pressurized container of shaving cream in a different manner. The support member 77 is generally unchanged except that it is shaped as shown at 78 in order to be more closely fitted to the cylindrical warming head 79. A primary inductor 80 having a winding 81 is located in the support member. The warming head has a plastic casing 82 which is shaped to conform to the size of a pressurized dispensing container 83. The container has an internally threaded ridge 84 around the top thereof which mates with threads on the downwardly extending portion of the warming head base 85. As shown in FIG. 7, the base of the warming head has a passageway 86 extending therethrough and is adapted to be press-fitted to the outlet valve of the pressurized dispensing container. Associated with the base, in the passageway thereof, is a simple ball type check valve 87 which permits the isolation of shaving cream within the warming head when pressures in the head and container are essentially equal and when the head pressure is greater than that in the container. A spring 89 holds the valve in closed position. A sealing gasket (not shown) is disposed in the passageway below the valve seat to insure leakproof sealing between the container and the warming head. Instead of a chamber, a spiral tube 90 of aluminum, copper or other metallic material receives shaving cream which has been separated or withdrawn from the container. The tube is connected at one end to the passageway 86 in the vicinity of the check valve 87 and at the opposite end with an outlet spout 91. A spring biased outlet valve 92 having a passageway therethrough is inserted in the outlet spout and is normally held in closed position by the spring 93. In order that the material contained within the tube can be heated, an insulated nichrome resistance heating element 94 is wrapped around the tube 90 throughout its entire length. The element is connected to the winding 95 of a secondary inductor 96 which is disposed opposite the tube. Connected in series with the resistance element and the secondary inductor is a thermostat 97 which is mounted on the casing of the warming head in any convenient manner and directly contacts tube 90.

In FIG. 8 there is illustrated an embodiment of the invention in which the only elements contained within the warming head are a conventional resistance heater, thermostat, switch actuated by button 17, outlet valve and spout. The transformer is located outside of the device as shown at 98. The casing 99 is in the shape of a longitudinal cylinder equipped with threads 100. Accordingly, the entire container 101 of pressurized shaving cream can be permanently inserted into the cylinder and held in place by means of the threaded closure member 102. Closure 102 need not be threaded and can be press-fitted or latched to the cylinder. Such a device is readily adaptable to being moved about, if desirable, or to being equipped with a support means 103 for attachment to a wall or the like.

In FIG. 9 there is illustrated an even more simplified modification of the present invention. It comprises a pressurized container 104 of shaving cream equipped with a coil of copper or aluminum tubing 105. The tubing is soldered or brazed to a conventional aerosol valve outlet 106 made of steel, brass or aluminum and is equipped with a suitable outlet valve 107 at the opposite end. When the container valve is opened, liquid shaving cream flows into and fills the tube. It is prevented from escaping by the valve 107 which is normally closed. The container valve is opened merely by unseating the valve mechanism. This is accomplished by moving the tube vertically downward. Allowing the tube to return to normal position will then reseat the container valve, thereby isolating in the tube, shaving cream which has flowed into it. The isolated portion of shaving cream is then heated by an convenient means such as an open flame or by flowing hot water over the tube until a desired temperature is attained. Thereupon, the outlet valve 107 is opened and warm lather is forced from the copper tube.

It is apparent that the device of this invention can be constructed to incorporate widely varying particular designs. However, regardless of the articular structure employed, the device permits the withdrawal, separation or isolation of a portion of fluent material under pressure from a pressurized source before temperature modification. In essence, therefore, as pointed out above, the present invention includes a process which comprises withdrawal, separation or isolation of a portion of fluent material under pressure from a pressurized source, modifying the temperature of the separated material while it is under pressure, preferably while maintaining it in a substantially unexpanded state, and subsequently dispensing the separated material in an expanded state after temperature modification. The process can be carried out within widely varying ranges of pressure and temperature which depend upon a number of factors. In general, the pressures in the system must be at least enough to propel the dispensable fluent material through the apparatus during each step of the process. On the other hand, the upper limit of pressure can be as much as necessary to achieve good dispensing speed so long as it is convenient from a viewpoint of safety, economy in the design of the device and use. However, it is preferred that the pressure be enough to maintain the separated dispensable fluid material in an unexpanded state, that is, in substantially the same state as at the pressurized source. In the field of dispensable aerosol compositions to which the instant device and process is particularly applicable, pressures in a range of about 20 to 200 pounds per square inch gauge are suitable for carrying out the process. However, pressures in a range of about 30 to 130 pounds per square inch gauge are generally preferred. In its application to the dispensing of heated shaving lather, the process is generally carried out at a pressure in a range of about 30 to 130 pounds per square inch gauge in both the container and chamber, and at temperatures of from about 40° C. to 60° C. in the heating zone, that is, the chamber.

In operation, the preferred form of the device shown in FIGS. 1 and 2 functions in accordance with the following explanation. Initially, a pressurized dispensing container 13 filled with liquid shaving cream and a normally gaseous propellant is fitted to the warming head 12. The container is then placed on the support member 11 and the device is connected to a source of electricity. In the embodiment shown in FIG. 2 of the drawings, the warming head, when threaded to the pressurized container lowers pin 29 into the outlet valve opening of the container permanently unseating the valve and permitting liquid shaving preparation to flow into the tube 24. When the pressure of the liquid flowing into the tube has built up sufficiently, check valve 26 is forced open and liquid shaving cream flow into chamber 22. When the pressures in the chamber and the container are substantially equal, the check valve closes, thereby separating the material in the chamber. Accordingly, the device is ready for the heating step when the warming head is attached. On actuation of button 17, electricity from the source then passes through the thermostatic time delay switch 48, lighting the indicator light 16, and to the primary inductor 42 which induces a current in the secondary inductor 41 located in the warming head 12. The resistance heating element 32 and safety thermostat 34, connected in series with the secondary inductor, are energized and the heating element becomes hot and heats the chamber wall which transmits heat energy to liquid shaving preparation in the chamber 22, but particularly in the restricted section 23 of the chamber. If the temperature of the shaving cream should exceed a present maximum, the thermostat 34 will open, thus causing cessation of heating in the chamber. When such a situation exists, a sharp rise in the primary inductor current, caused by the open secondary circuit, will cause the thermal time delay switch 43 to open thereby inactivating the entire device. When the temperature of the thermostatic element in the time delay switch has reached the desired level, the circuit is opened, thereby preventing overheating and the light 16 goes off, indicating the device is not in a heating cycle. It will be apparent that the thermal time delay switch and the thermostat are pre-set so that the shaving cream in the chamber will be heated to the desired temperature.

In order to dispense the liquid shaving cream which has been so heated, the dispensing valve 37 located on top of the chamber is then activated by depressing valve actuator 21 and opening the chamber to the atmosphere to permit heated pressurized shaving cream to be forced up through the dip tube 40 and out through the outlet spout for use as expanded lather. As the pressure in the chamber decreases, due to the exit of the heated shaving cream which expands to form a rich foam as it leaves the dispensing spout, the check valve automatically is forced open by the higher pressure in the pressurized container forcing additional liquid shaving cream into the large upper part of the chamber, thereby preparing the device for a succeeding warming and dispensing step.

It will be apparent that the chamber can vary in size and it is therefore possible to dispense a predetermined amount of heated shaving cream on other fluent material with the device of this invention. However, the size of the chamber should not be so great that it is impossible to retain the fluent material in a substantially unexpanded state therein. It is to be understood, however, that the language employed herein and the expanded claims referring to the separated portion of fluent material as being in a substantially unexpanded state is meant to include the presence of some expanded material or foam in the chamber. For example, the initial charge of liquid shaving cream forced into the chamber is flowing from an area of high pressure to an area of lower pressure. Accordingly, the initial amounts flowing into the chamber will foam until the pressure in the chamber has reached certain limits. Such foaming will usually be kept to a minimum. Expansion of the product in the chamber can be controlled by a number of factors, such as the size of the chamber, the size of the container, the pressure differential between container and chamber necessary to open or close the check valve, the rate of flow or discharge and the pressure in the chamber itself. Although these factors will differ for any particular apparatus, the device should be constructed so that foaming in the chamber is held to a minimum in order to obtain good heat transfer and dispensing of a sufficient volume of a rich, warm lather of suitable consistency. The restricted lower part of the chamber into which the dip tube extends is advantageous in cases where foaming does tend to take place in the chamber. For example, when liquid shaving preparation is flowed into the chamber, the liquid will go to the bottom of the chamber and any portion which has expanded to foam will float on the surface of the liquid. Accordingly, only liquid will be dispensed from the bottom of the chamber through the dip tube at reduced pressure through the outlet valve in an expanded state.

The chamber into which the fluent material such as liquid shaving cream is withdrawn, separated or isolated under pressure can, at the same time, function to transmit heat from any source to the material contained therein in accordance with the embodiment shown in FIG. 9 of the drawings. On the other hand, heating means can include the circuiting shown in the preferred form of the invention or any other suitable heating arrangement and the tube and check valve arrangement of the most preferred form of the invention function as part of the means for withdrawing, separating or isolating the fluent material under pressure prior to heating and dispensing.

The new device of this invention can be employed to dispense a wide variety of fluid materials at modified temperatures. If it is desired to cool the dispensable material, the device can be equipped with a means to lower the temperature rather than to raise it or cold water or other cooling means can be applied to embodiments of the invention like the simplified device shown in FIG. 9.

The invention has been described with reference to certain non-limiting illustrations thereof. It is clear that other embodiments thereof may be made and equivalents may be substituted therein without being outside the scope of the invention or the appended claims.

What is claimed is:

1. A device for dispensing lather at elevated temperature from a container provided with a discharge valve and containing a body of liquid shaving cream pressurized with a normally gaseous propellant comprising a heating chamber having an inlet opening, passage means connecting the inlet opening of said heating chamber to said discharge valve, a check valve in said passage for separating the heating chamber from the body of shaving cream and for maintaining the pressure in said heating chamber that obtains when pressurized liquid shaving cream in the heating chamber is heated, means whereby said heating chamber may be heated, and outlet valve means communicating with said heating chamber, to discharge liquid shaving cream from said chamber to the atmosphere, as lather, after heating.

2. A device for dispensing a liquid material at a modified temperature comprising a container containing a body of liquid material pressurized with a normally gaseous propellant and provided with a discharge valve, means connected to said container for holding a portion of pressurized liquid material from said body under pressure sufficient to maintain it in a substantially unexpanded state and separate from said body, means to pass said material from said container to said holding means while preventing any flow of material from said holding means to said container, a first electrical means for heating the separated portion, a second electrical means for inducing a current in said first electrical means and means for discharging said separated portion to the atmosphere in an expanded state after the temperature thereof has been modified.

3. A device for dispensing lather at elevated temperature from a container provided with a discharge valve and containing a body of liquid shaving cream pressurized with a normally gaseous propellant comprising a heating chamber having an inlet opening, passage means connecting the inlet opening of said heating chamber to said discharge valve, a check valve in said passage for separating the heating chamber from the body of shaving cream and for maintaining the pressure in said heating chamber that obtains when pressurized liquid shaving cream in the heating chamber is heated, a first electrical means surrounding said heating chamber for heating liquid shaving cream in said chamber, a second electrical means for inducing a current in said first electrical means and outlet valve means communciating with said heating chamber, to discharge liquid shaving cream from said chamber to the atmosphere, as lather, after heating.

4. A device for dispensing lather at an elevated temperature comprising a support member for a container containing a body of liquid shaving cream pressurized with a normally gaseous propellant and provided with a discharge valve, a heating chamber having an inlet opening, a tube connecting the inlet opening of said heating chamber to said discharge valve, a check valve in the tube for separating the heating chamber from the body of shaving cream and for maintaining the pressure in said heating chamber that obtains when pressurized liquid shaving cream in the heating chamber is heated, a first electrical circuit located in said support member, a second electrical circuit which has a resistance heating element surrounding said chamber, the first electrical circuit adapted to induce a current in the second electrical circuit and thereby to generate heat and to heat liquid shaving cream in said chamber to above about 40° C. and an outlet valve communicating with said chamber to discharge liquid shaving cream from said chamber to the atmosphere, as lather, after heating thereof.

5. A device for dispensing lather at an elevated temperature from a body of liquid shaving cream at a lower temperature comprising a support member adapted to receive in close relationship therewith a pressurized dispensing container of liquid shaving cream containing a normally gaseous propellant, which container has a normally closed outlet valve which opens when depressed, a primary circuit within said support member including means for connection to a source of electricity, a warming head affixable to the outlet valve of the pressurized dispensing container, a chamber located in said warming head, said chamber being fitted with a dispensing valve and an actuator rod therefor and being connectable with the pressurized dispensing container through a fitting which communicates with said chamber through a first passage, said actuator rod extending downwardly through said fitting and to the outlet valve of the pressurized dispensing container, a second passage in said chamber communicating with the dispensing valve thereon and having an opening near the bottom of the chamber, and a secondary circuit located in the warming head including a resistance heating element which heats liquid shaving cream in the chamber upon induction of a current in said secondary circuit by the primary circuit, which shaving cream is dispensable to the atmosphere as expanded, heated lather when the actuator rod is depressed, thereby opening the dispensing valve on the chamber and the outlet valve on the pressurized dispensing container and allowing withdrawal and separation of a portion of liquid shaving cream from said container into said chamber in a substantially unexpanded state for heating and subsequent dispensing to the atmosphere as expanded, heated lather.

6. A device for dispensing lather at an elevated temperature from a body of liquid shaving cream at lower temperature comprising a support member adapted to receive in close relationship therewith a pressurized dispensing container of liquid shaving cream containing a normally gaseous propellant, which container has an outlet valve, a primary circuit within said support member including means for connection to a source of electricity, a warming head affixable to the outlet valve of the pressurized dispensing container, a chamber having a lower restricted section and a larger upper section located in said warming head, the larger upper section being fitted with a dispensing valve and actuator therefor and being connectable with the pressurized dispensing container through a tube which has a check valve positioned therein which opens and closes in response to pressure differentials between said dispensing container and said chamber, allowing the withdrawal and separation of a portion of liquid shaving cream from the pressurized dispensing container into the chamber in a substantially unexpanded state when the container outlet valve is open, and a secondary circuit located in the warming head including a resistance heating element which heats liquid shaving cream in the chamber upon induction of a current in said secondary circuit by the primary circuit, which shaving cream is dispensable to the atmosphere as expanded heated lather when the outlet valve on the chamber is opened by the dispensing valve actuator.

7. A device for dispensing lather at an elevated temperature from a body of pressurized liquid shaving cream at lower temperature which comprises a support member having an upright back and a base and adapted to receive in close relationship therewith a pressurized dispensing container of liquid shaving cream containing a liquefied normally gaseous propellant, which container has an outlet valve, a warming head affixable to the container and communicable with the outlet valve, means for connection to a source of electricity, a switch located on said support member, a primary circuit within said support member and comprising an inductor connected with an indicating light located on said upright back and in series with a preset thermostatic time delay switch, which is closable in response to the switch, the warming head comprising a casing, a chamber having a lower restricted section and a larger upper section located within said casing, the larger upper section being fitted with a dispensing valve and actuator therefor, said dispensing valve having a dip tube fitted thereon which extends downwardly into the lower restricted section of said chamber, the chamber being connectable with said pressurized dispensing container through a tube, which tube is joined to the larger upper chamber section and has a check valve positioned therein which opens and closes in response to pressure differentials between said dispensing container and said chamber to allow the withdrawal and separation of a portion of liquid shaving cream from said pressurized dispensing container into said chamber in a substantially unexpanded state when the container outlet valve is open, a fitting on an end of said tube opposite the juncture of the tube with the chamber and a pin disposed in said fitting and projecting downwardly and to the outlet valve of the pressurized dispensing container, thereby unseating the outlet valve and holding it in open position to allow liquid shaving cream from said pressurized dispensing container to flow into said tube when the fitting is in place on the container, a secondary circuit located in the warming head, said secondary circuit comprising a resistance heating element wrapped around the lower restricted section of the chamber and connected in series with a thermostat and a secondary inductor into which current is induced by the primary inductor, thereby heating the wall of said chamber, which wall transmits heat to liqid shaving cream contained in the chamber, which shaving cream is dispensable to the atmosphere as expanded, heated, lather when the outlet valve on said chamber is opened by movement of the dispensing valve actuator.

8. A device for preparing and dispensing heated aerosol foams from an aerosol-type container:

a. provided with an outlet member having an open position and a closed position and,
b. containing therein a mixture of an aqueous soap solution and a liquefied normally-gaseous propellant,
c. said device comprising a heat-conductive chamber,
d. having an inlet member interconnected with the outlet member of said container,
e. means on said inlet member for maintaining said outlet member in the open position,
f. means mounted within said inlet member for preventing fluid flow from said chamber to said container,
g. and an outlet member having a manually-operated discharge valve for dispensing the contents for use,
h. and means whereby said heat-conductive chamber may be heated.

9. A device for preparing and dispensing heated aerosol foams from an aerosol-type container:

a. provided with an outlet member having an open position and a closed position, and,
b. containing therein a mixture of an aqueous soap solution and a liquefied normally-gaseous propellant,
c. said device comprising a heat-conductive chamber,
d. having an inlet member interconnected with the outlet member of said container,
e. means on said inlet member for maintaining said outlet member in the open position,
f. means mounted within said inlet member for preventing fluid flow from said chamber to said container,
g. an an outlet member having a manually-operated discharge valve for dispensing the contents for use,
h. and an element in heat exchange relation with said heat conductive chamber.

10. A device for preparing and dispensing heated aerosol foams form an aerosol-type container:

a. provided with an outlet member having an open position and a closed position and,
b. containing therein a mixture of an aqueous soap solution and a liquefied normally-gaseous propellant,
c. said device comprising a heat-conductive chamber,
d. having an inlet member interconnected with the outlet member of said container,
e. means on said inlet member for maintaining said outlet member in the open position,
f. a check valve mounted within said inlet member as to permit fluid flow from said container to said chamber but as to prevent fluid flow from said chamber to said container,
g. and an outlet member having a manually-operated discharge valve for dispensing the contents for use,
h. and means whereby said heat-conductive chamber may be heated.

11. A device for preparing and dispensing heated aerosol foams from an aerosol-type container:

a. provided with an outlet member having an open position and a closed position and, b. containing therein a mixture of an aqueous soap solution and a liquefied normally-gaseous propellant, c. said device comprising a heat-conductive chamber, d. having an inlet member interconnected with the outlet member of said container, e. means on said inlet member for maintaining said outlet member in the open position, f. a check valve mounted within said inlet member as to permit fluid flow from said container to said chamber but as to prevent fluid flow from said chamber to said container, g. and an outlet member having a manually-operated discharge valve for dispensing the contents for use, h. and an element in heat exchange relation with said heat conductive chamber.

* * * * *